US009651903B2

(12) United States Patent
Shiki et al.

(10) Patent No.: US 9,651,903 B2
(45) Date of Patent: May 16, 2017

(54) FIXING DEVICE AND IMAGE-FORMING APPARATUS USING THE SAME

(71) Applicant: KONICA MINOLTA, INC., Chiyoda-ku, Tokyo (JP)

(72) Inventors: Takanobu Shiki, Tokyo (JP); Kenji Tamaki, Saitama-ken (JP); Kenji Yamamoto, Tokyo (JP); Yukinobu Iguchi, Shizuoka-ken (JP); Kosuke Sasaki, Kanagawa-ken (JP); Shohei Otsu, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 131 days.

(21) Appl. No.: 14/710,523

(22) Filed: May 12, 2015

(65) Prior Publication Data

US 2015/0338793 A1 Nov. 26, 2015

(30) Foreign Application Priority Data

May 20, 2014 (JP) ..... 2014-104525

(51) Int. Cl.
*G03G 15/20* (2006.01)

(52) U.S. Cl.
CPC ..... *G03G 15/205* (2013.01); *G03G 15/2039* (2013.01)

(58) Field of Classification Search
CPC ..... G03G 15/205; G03G 15/2039
USPC ..... 399/67–70; 219/216
See application file for complete search history.

(56) References Cited

U.S. PATENT DOCUMENTS

| | | | | |
|---|---|---|---|---|
| 6,177,657 | B1 | 1/2001 | Takata et al. | |
| 8,036,558 | B2 | 10/2011 | Nakashima | |
| 8,805,225 | B2 | 8/2014 | Waida et al. | |
| 2013/0202322 | A1 | 8/2013 | Waida et al. | |
| 2014/0348528 | A1* | 11/2014 | Tamaki | G03G 15/205 399/69 |

FOREIGN PATENT DOCUMENTS

| | | | |
|---|---|---|---|
| JP | 09080961 | A | 3/1997 |
| JP | 11344899 | A | 12/1999 |

(Continued)

OTHER PUBLICATIONS

Japanese Office Action (and English translation thereof) dated Aug. 16, 2016 issued in counterpart Japanese Application No. 2014-104525.

(Continued)

*Primary Examiner* — Walter L Lindsay, Jr.
*Assistant Examiner* — Ruth Labombard
(74) *Attorney, Agent, or Firm* — Holtz, Holtz & Volek PC

(57) ABSTRACT

When changing the turn-on/off patterns, a controller of a fixing device sets a control interval of the turn-on/off pattern so as to be longer than a first period of time that does not exert any influence to a flicker value and to be shorter than a second period of time that does not exert any influence to a response to temperature control. The controller of the fixing device selects a third turn-on/off pattern in which power difference between power of a first turn-on/off pattern before the change in the turn-on/off pattern and power of a second turn-on/off pattern after the change in the turn-on/off pattern is smaller than a set reference power difference.

20 Claims, 10 Drawing Sheets

(56) References Cited

FOREIGN PATENT DOCUMENTS

| | | | |
|---|---|---|---|
| JP | 2009237070 | A | 10/2009 |
| JP | 2013130891 | A | 7/2013 |
| JP | 2013156340 | A | 8/2013 |
| JP | 2013167751 | A | 8/2013 |

OTHER PUBLICATIONS

Japanese Office Action (and English translation thereof) dated Jan. 17, 2017 issued in counterpart Japanese Application No. 2014-104525.

* cited by examiner

FIG. 5

| TURN-ON/OFF PATTERN | ON/OFF RELATIONSHIP | DUTY (%) | DETERMINATION RESULT | |
|---|---|---|---|---|
| | | | 1000W OR MORE | LESS THAN 1000W |
| 1 | 8/9 | 88.89 | X | O |
| 2 | 9/11 | 81.8 | O | O |
| 3 | 5/7 | 71.43 | X | X |
| 4 | 5/7 | 71.43 | O | - |
| 5 | 2/3 | 66.67 | O | O |
| 6 | 4/7 | 57.14 | X | - |
| 7 | 4/7 | 57.14 | O | O |

FIXING DEVICE AND IMAGE-FORMING APPARATUS USING THE SAME

CROSS REFERENCE TO RELATED APPLICATION

The present invention contains subject matter related to Japanese Patent Application No. JP 2014-104525 filed in the Japanese Patent Office on May 20, 2014, the entire contents of which being incorporated herein by reference.

BACKGROUND OF THE INVENTION

Technical Field

The present invention relates to a fixing device and an image-forming apparatus using the same.

Background Art

An image-forming apparatus of an electrophotographic system having multifunction such as a printer, a copier, a facsimile and the like has been widely known in the past. The image-forming apparatus has formed an image on a sheet through a series of processes such that the image has been transferred to the sheet and then, the image has been fixed on the sheet. The image-forming apparatus has been provided with a fixing device that performs a fixing process. The fixing device has a fixing heater(s) for performing a heat transfer on the sheet. As the fixing heater, for example, a halogen lamp can be used.

In the image-forming apparatus, an energy-saving (reduction of power consumption) has been requested in recent years. In order to realize the energy-saving of the image-forming apparatus, it has been known that reduction of power consumption in the fixing device is effective. Although heat capacity of the fixing device has been generally reduced in order to reduce the power consumption in the fixing device, temperature ripple of the fixing device may be increased when reducing the heat capacity of the fixing device. This may exert a great influence on fixing performance of the fixing device.

Accordingly, the power of the fixing device has been controlled in the past under a duty variable control by, for example, phase control or PWM control so that the temperature ripple of the fixing device may be decreased. It, however, is desirable that the fixing device may conform to various kinds of standards such as noise terminal voltage, harmonic distortion restraint, flicker regulation and the like in addition to the temperature ripple. As one of the methods of controlling power which are effective in conforming to these various kinds of standards, a technology has been known to control a heater to turn on or off the power thereof under an on-off pattern (s) of the heater (s) with half wave interval of AC power supply being constituted as a unit thereof.

For example, Japanese Patent Application Publication No. 2009-237070 has disclosed an image-forming apparatus wherein a fixing heater turns on or off based on a turn-on/off pattern of the fixing heater including ON intervals in which the fixing heater is to be turned on and OFF intervals in which the fixing heater is to be turned off. Either ON intervals or OFF intervals, which have smaller total number of half waves (units) in a repetition cycle, are discontinuous.

Japanese Patent Application Publication No. H09-80961 has disclosed a fixing device which supplies power to a heater so as to turn the heater on or off based on AC discontinuous driving pattern, whereby supplying the power which is less than rated power by AC continuous driving turn-on during a predetermined period of time from at least on-timing of the heater.

Japanese Patent Application Publication No. H11-344899 has disclosed a fixing device in which a control device selects one of a plurality of specified periods in accordance with duration of specified periods and then, controls the switching of switching device during the selected specified periods.

SUMMARY OF THE INVENTION

Issues to be Addressed by the Invention

However, when the fixing device is composed plural heaters, the image-forming apparatus and the fixing devices disclosed in Japanese Patent Application Publications Nos. 2009-237070, H09-80961 and H11-344899 turn on or off respective heaters based on turn-on/off patterns with half wave of AC power supply being constituted as a unit. Even when using a turn-on/off pattern that is expedient to flicker, any influence may be exerted on a flicker value in a case where there is a large power difference between supplied power before the change of the turn-on/off pattern and supplied power after the change of the turn-on/off pattern. Further, when a period of changing time of the turn-on/off pattern (control interval) elongates, any influence may be exerted on a flicker value.

Means for Solving the Issues

This invention addresses the above-mentioned issues and has an object to provide an improved fixing device and an improved image-forming apparatus using the same.

To achieve the above-mentioned the object, a fixing device reflecting one aspect of this invention contains an alternating current power supply, plural heaters each fixing an image on a sheet, a switching unit that switches from a turn-on state of the heaters in which the heaters are connected to the alternating current power supply to a turn-off state of the heaters in which the heaters are disconnected from the alternating current power supply or from the turn-off state of the heaters to the turn-on state of the heaters, and a control unit that controls the switching unit to switch under a turn-on/off pattern with a half wave interval of the alternating current power supply being constituted as a unit thereof and to turn on or off the plural heaters, wherein when changing the turn-on/off pattern, the control unit sets a control interval as a period of switching time in the turn-on/off pattern so as to be longer than a first period of time that does not exert any influence to a flicker value and to be shorter than a second period of time that does not exert any influence to a response to temperature control or the control unit selects a third turn-on/off pattern in which power difference between power of a first turn-on/off pattern before the change in the turn-on/off pattern and power of a second turn-on/off pattern after the change in the turn-on/off pattern is smaller than a set reference power difference.

It is desirable to provide the fixing device wherein when the power difference between the power of the first turn-on/off pattern before the change in the turn-on/off pattern and the power of the second turn-on/off pattern after the change in the turn-on/off pattern exceeds the reference power difference, the control unit sets a control interval of at least any one of the second and third turn-on/off patterns so as to be longer than the first period of time and shorter than the second period of time.

It is also desirable to provide the fixing device wherein the first period of time is 900 ms and the second period of time is 1500 ms.

It is further desirable to provide the fixing device wherein the reference power difference is 330 W.

It is additionally desirable to provide the fixing device wherein when the power difference between the power of the first turn-on/off pattern before the change in the turn-on/off pattern and the power of the second turn-on/off pattern after the change in the turn-on/off pattern exceeds the reference power difference, the control unit inserts the third turn-on/off pattern between the first and second turn-on/off patterns, the third turn-on/off pattern being completed at a unit of the control interval of each of the first and second turn-on/off patterns.

It is still further desirable to provide the fixing device wherein when the power difference between the power of the first turn-on/off pattern before the change in the turn-on/off pattern and the power of the second turn-on/off pattern after the change in the turn-on/off pattern exceeds the reference power difference, the control unit inserts the third turn-on/off pattern between the first and second turn-on/off patterns, the third turn-on/off pattern having a shorter interval than a reference control interval of the first and second turn-on/off patterns.

It is still additionally desirable to provide the fixing device wherein the control unit determines whether or not the heaters are turned on or off under the third turn-on/off pattern based on processing capacity of the control unit.

It is also desirable to provide the fixing device wherein when the heaters turn on or off under the third turn-on/off pattern, the control portion controls the switching unit to turn the heaters on or off at a processing speed faster than both of processing speeds at which the heaters turn on or off under the first and second turn-on/off patterns.

It is still further desirable to provide the fixing device wherein when the power difference between the power of the first turn-on/off pattern before the change in the turn-on/off pattern and the power of the second turn-on/off pattern after the change in the turn-on/off pattern exceeds the reference power difference, the control unit inserts the third turn-on/off pattern between the first and second turn-on/off patterns, the third turn-on/off pattern having a longer interval than the control interval of each of the first and second turn-on/off patterns, and after the third turn-on/off pattern completes, the control unit changes the third turn-on/off pattern to the second turn-on/off pattern to start counting the control interval of the second turn-on/off pattern.

It is still additionally desirable to provide the fixing device wherein each of the turn-on/off patterns is configured to include 10 half wave intervals or more of the alternating current power supply as one control interval.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIG. 5 is a table showing a relationship between each turn-on/off pattern and a determination result of flicker;

DESCRIPTION OF THE PREFERRED EMBODIMENTS

Figure 1:
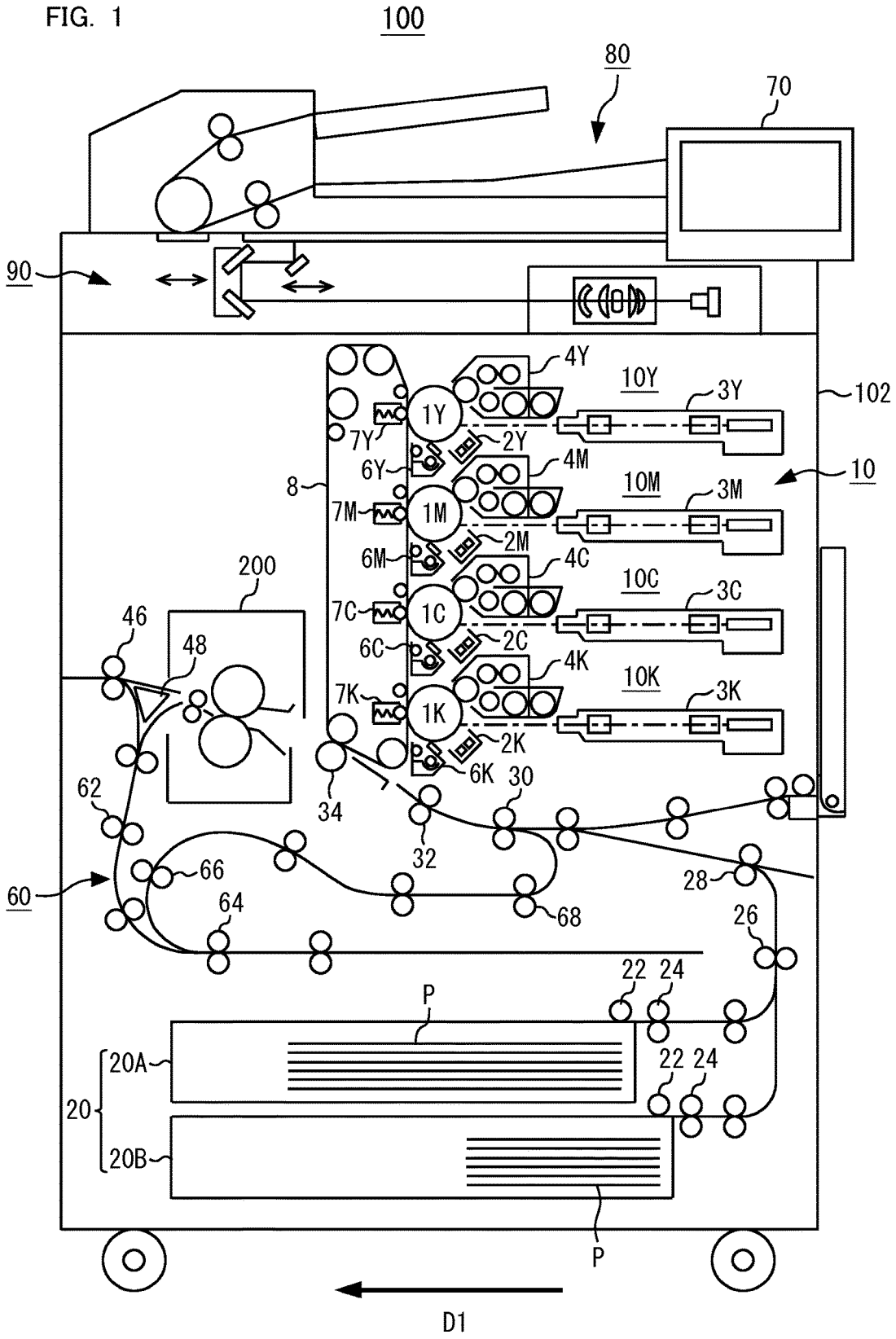
FIG. 1 is a diagram showing a configuration example of an image-forming apparatus according to a first embodiment of this invention.

The following will describe configuration examples of the fixing device and the image-forming apparatus as preferred embodiments relating to the invention with reference to drawings. Size and ratio are exaggerated in the drawings for convenience of explanation and they may be different from real ones. It is to be noted that the description in the embodiments is exemplified and any technical scope of the claims and/or meaning of term(s) claimed in the claims are not limited thereto.

First Embodiment

Configuration Examples of Image-forming Apparatus

The following will describe the image-forming apparatus 100 according to the first embodiment of the invention. FIG. 1 shows a configuration example of the image-forming apparatus 100 according to the first embodiment of this invention. As shown in FIG. 1, the image-forming apparatus 100 is an image forming apparatus called as "tandem type image-forming apparatus". The image-forming apparatus 100 contains an automatic document feeding portion 80 and an apparatus main body 102. The apparatus main body 102 mounts the automatic document feeding portion 80. The automatic document feeding portion 80 feeds sheets set on a document table successively to an image-reading portion 90 of the apparatus main body 102 using conveying rollers and the like.

The apparatus main body 102 contains a manipulation/display portion 70, the image-reading portion 90, an image-forming portion 10, an intermediate transfer belt 8, a feeder 20, a pair of registration rollers 32, a fixing device 200 and an auto duplex unit (ADU) 60.

The manipulation/display portion 70 contains a touch panel in which a manipulation part and a display unit are combined, and various kinds of operation keys such as determination keys, a start key and the like, which surround the touch panel. The manipulation/display portion 70 displays a menu screen or the like on its screen and receives any information about the image-forming conditions and the fixing conditions input by a user through a touch operation on the menu screen and/or an operation of the operation keys.

The image-reading portion 90 scans and exposes the document mounted on the document table or the document fed by the automatic document feeding portion 80 using an optical system in a scanning and exposure device. The image reading portion 90 also performs photoelectric conversion on a scanned image of the document by a charge-couple device (CCD) image sensor to obtain an image information signal. The image-processing portion, not shown, then performs a predetermined processing such as an analog processing, analog-to-digital (A/D) conversion processing, a shade correction, image compression processing and the like on this image information signal and outputs it to the image-forming portion 10.

The image-forming portion 10 forms an image based on an electrophotographic method. The image-forming portion 10 includes an image-forming unit 10Y which forms a yellow (Y) image, an image-forming unit 10M which forms a magenta (M) image, an image-forming unit 10C which forms a cyan (C) image, an image-forming unit 10K which forms a black (K) image. In this embodiment, in order to indicate a color relative to common function or name, Y, M, C or K will be attached to the number of the common function or name, for example, 10Y, 10M, 10C and 10K.

The image-forming unit 10Y includes a photosensitive drum 1Y, a charging portion 2Y arranged around the photosensitive drum 1Y, a writing (exposure) portion 3Y, a developing portion 4Y, a cleaning portion 6Y and a pair of primary transfer rollers 7Y. The image-forming unit 10M. includes a photosensitive drum 1M, a charging portion 2M arranged around the photosensitive drum 1M, an exposure portion 3M, a developing portion 4M, a cleaning portion 6M and a pair of primary transfer rollers 7M. The image forming unit 10C includes a photosensitive drum 1C, a charging portion 2C arranged around the photosensitive drum. 1C, an exposure portion 3C, a developing portion 4C, a cleaning portion 6C and a pair of primary transfer rollers 7C. The image forming unit 10K includes a photosensitive drum 1K, a charging portion 2K arranged around the photosensitive drum 1K, an exposure portion 3K, a developing portion 4K, a cleaning portion 6K and a pair of primary transfer rollers 7K.

The respective photosensitive drums (image carriers) 1Y, 1M, 1C and 1K, the respective charging portions 2Y, 2M, 2C and 2K, the respective exposure portions 3Y, 3M, 3C and 3K and the respective developing portions 4Y, 4M, 4C and 4K of the image forming units 10Y, 10M, 10C and 10K, the cleaning portions 6Y, 6M, 6C and 6K and the pairs of primary transfer rollers 7Y, 7M, 7*c* and 7K have the same configuration as each other. They will be indicated in the following description with Y, M, C and K being omitted except for a case in which any distinction thereof is required.

Each of the charging portions 2 uniformly charges static charges around a surface of each of the photosensitive drums 1. Each of the exposure portions 3 contains LED print head (LPH) including LED array and an image-formation lens, and a laser scanning and exposure apparatus with polygon mirror system. Each of the exposure portions 3 scans each of the photosensitive drums 1 by laser light based on the image information signal to form electrostatic latent images on each of the photosensitive drums 1. Each of the developing portions 4 develops the electrostatic latent images formed on each of the photosensitive drums 1 using toners. Thus, a toner image that is visible image is formed on each of the photosensitive drums 1.

The intermediate transfer belt 8 is an endless belt. The intermediate transfer belt 8 runs on plural rollers with it being stretched and supported by them. Together with the rotation of the intermediate transfer belt 8, each of the primary transfer rollers 7 and each of the photosensitive drums 1 rotate. When applying a predetermined electric voltage between each of the primary transfer rollers 7 and each of the photosensitive drums 1, the toner image formed on each of the photosensitive drums 1 is transferred on the intermediate transfer belt 8 (Primary Transfer).

The feeder 20 has plural feeding trays 20A, 20B each containing sheets P with a size such as A3, A4 or the like. The feeder 20 feeds the sheets P one by one from the selected feeding tray 20A or 20B and conveys the fed sheet P to a pair of loop-forming rollers 30 through conveying rollers 22, 24, 26 and 28 and the like. It is to be noted that numbers of the feeding trays are not limited to two. A single or plural large capacity sheet feeder(s), which can contain a large number of sheets P, may connect the image-forming apparatus depending on the situation.

The pair of loop-forming rollers 30 hits a forward end of the conveyed sheet P to the pair of registration rollers 32. The pair of registration rollers 32 forms a loop in the hit sheet P so that a skew (for example, inclination) of the sheet P in relation to a sheet-feeding direction D1 of the sheet P is corrected. The pair of registration rollers 32 conveys the sheet P, the skew of which is corrected, to secondary transfer rollers 34 at desired timing. The secondary transfer rollers 34 transfer toner images of colors Y, M, C and K transferred on the intermediate transfer belt 8 altogether to a surface of the sheet P fed by the pair of registration rollers 32 (Secondary Transfer). The secondary transfer rollers 34 then conveys the sheet P on which the secondary transfer is formed to the fixing device 200 that is arranged at a downstream side along the sheet-feeding direction D1 of the sheet P.

The fixing device 200 contains a pressure roller and a heating roller. The fixing device 200 fixes the toner images transferred on the surface of the sheet P to the sheet P by applying pressure to the sheet P to which the secondary transfer rollers 34 has transferred the toner images and heating the same. The fixing device 200 will be later described more in detail.

A conveying path changeover portion 48 is provided at the downstream side of the fixing device 200 along the sheet-feeding direction Dl. The conveying path changeover portion 48 performs changeover control of the conveying path to change the conveying path of the sheet P to a sheet-ejection side or a side of auto duplex unit (ADU) 60. The conveying path changeover portion 48 performs changeover control of the conveying path based on a selected printing mode (single surface printing mode or duplex printing mode).

Ejection rollers 46 eject onto a sheet-ejection tray, not shown, the sheet P, a single surface of which has been printed in the single surface printing mode or both surfaces of which have been printed in the duplex printing mode.

When re-feeding the sheet P, on a surface side of which an image has been printed, to the image forming portion 10 during the duplex printing mode in order to form an image on a rear surface of the sheet P, the conveying rollers 62 and the like convey the sheet P to ADU 60. In the switchback route of the ADU 60, ADU rollers 64 perform a reverse rotation control on the sheet P to convey the sheet P to a U-turn path with a rear end of the sheet P being lead. The conveying rollers 66, 68 and the like provided in the U-turn path re-feed the sheet P to the pair of secondary transfer rollers 34 while front and back of the sheet P is reversed.

Configuration Example of Fixing Device

Figure 2:
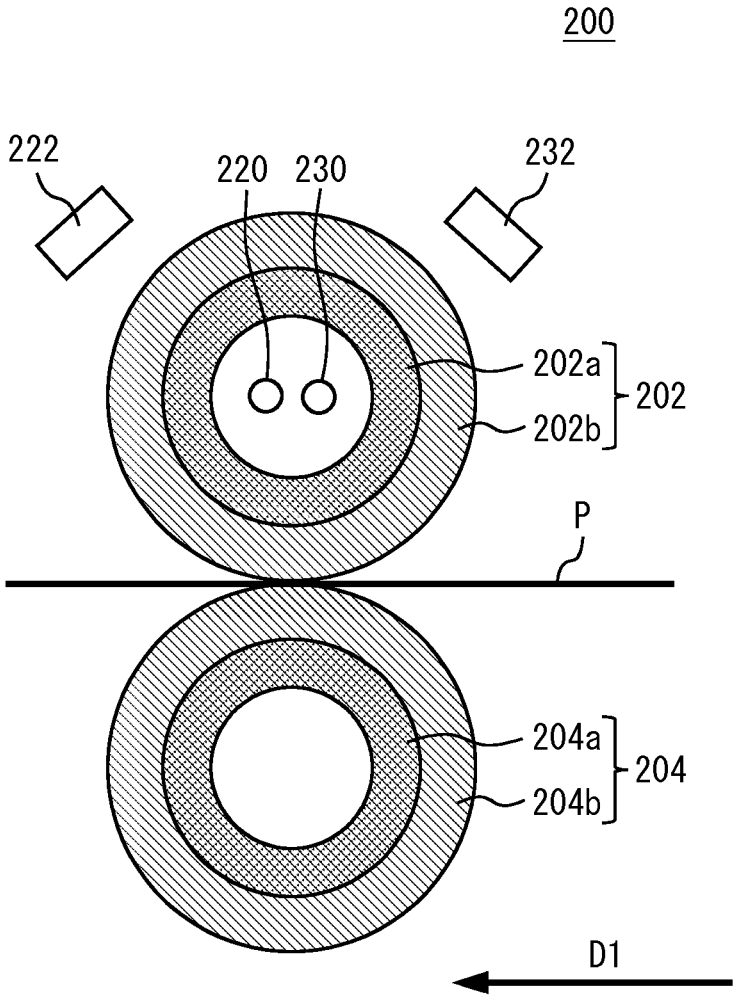
FIG. 2 is a sectional view of a fixing device according to the first embodiment of this invention showing a configuration example thereof.

The following will describe a configuration example of the fixing device 200 according to an embodiment of the invention with reference to FIG. 2. As shown in FIG. 2, the fixing device 200 contains a heating roller (fixing roller) 202, a pressure roller 204, temperature detection units 222, 232, a first heater 220 and a second heater 230.

The heating roller 202 contains a cylindrical core 202*a* and a function layer 202*b* made of resin layer, elastic layer and/or the like, which covers a peripheral surface (surface) of the cylindrical core 202*a*. The pressure roller 204 contains a cylindrical core 204*a* and a function layer 204*b* made of resin layer, elastic layer and/or the like, which covers a peripheral surface (surface) of the cylindrical core 204*a*. The pressure roller 204 is arranged so that it is opposed to the heating roller 202. The pressure roller 204 is able to pressure for the heating roller 202.

The first and second heaters 220, 230 are arranged inside the cylindrical core 202*a* of the heating roller 202. The first and second heaters 220, 230 are composed of, for example, halogen heaters. The first and second heaters 220, 230 perform any temperature control on the heating roller 202 based on a turn-on/off control under a predetermined turn-on/off pattern. It is to be noted that although the heaters have been illustrated as two heaters in this embodiment, this invention is not limited thereto: The heater(s) may be composed of one heater or three heaters. Further, the first and second heaters 220, 230 may be configured so that they are different from each other in a distribution of supplied heat.

The temperature detection unit 222 is arranged near the first heater 220 and detects temperature of the first heater 220. The temperature detection unit 232 is arranged near the second heater 230 and detects temperature of the second heater 230. For example, thermistor or the like is available for the temperature detection units 222, 232.

Configuration Example of Image-forming Apparatus

Figure 3:
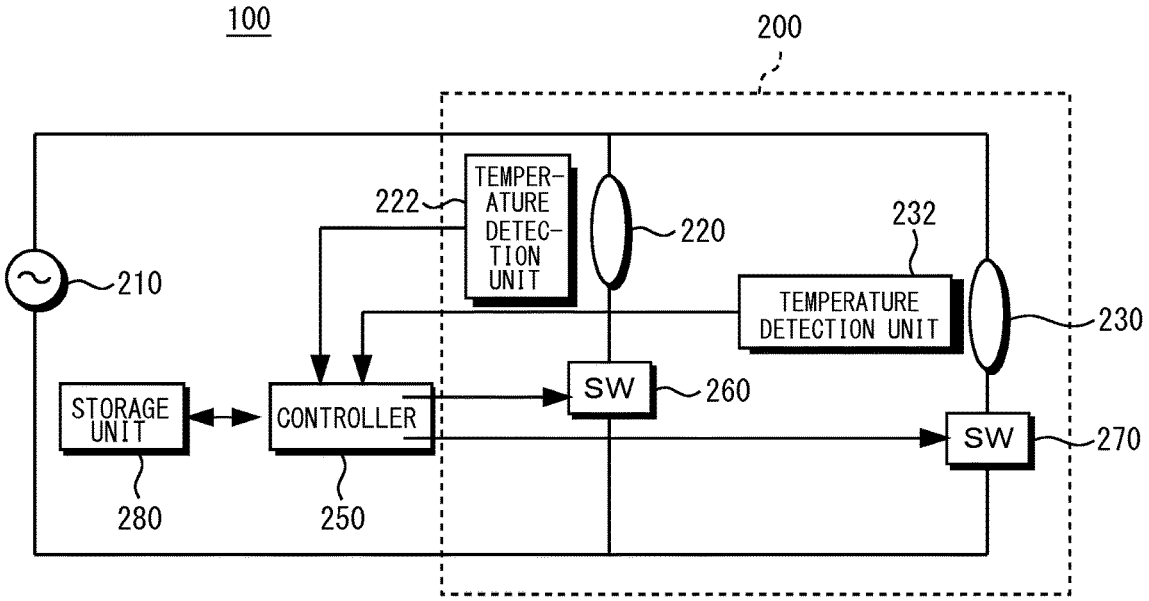
FIG. 3 is a block diagram showing a configuration example of the image-forming apparatus.

FIG. 3 shows a configuration example of the image-forming apparatus 100. As shown in FIG. 3, the image-forming apparatus 100 includes an alternating current power supply 210, the fixing device 200, a controller 250, and a storage unit 280. The alternating current power supply 210 is installed in office or the like in which the image-forming apparatus is installed and supplies predetermined power to the image-forming apparatus 100 including the fixing device 200.

The fixing device 200 includes the first heater 220, the temperature detection unit 222, the second heater 230, the temperature detection unit 232, and switches 260, 270. The first and second heaters 220, 230 are connected in parallel to the alternating current power supply 210 through an electric power line.

The first heater 220 turns on or off the power supplied from the alternating current power supply 210 with a predetermined duty ratio to perform the temperature control on the fixing device 200. The temperature detection unit 222 detects temperature of the first heater 220 and outputs any detected temperature information to the controller 250.

The switch 260 is arranged between the alternating current power supply 210 and the first heater 220 through the electric power line and is composed of switching elements such as triac. The switch 260 switches from a turn-on state of the first heater 220 in which the first heater 220 is connected to the alternating current power supply 210 to a turn-off state of the first heater 220 in which the first heater 220 is disconnected from the alternating current power supply 210 or vice versa.

The second heater 230 also turns on or off the power supplied from the alternating current power supply 210 with a predetermined duty ratio to perform the temperature control on the fixing device 200. The temperature detection unit 232 detects temperature of the second heater 230 and outputs any detected temperature information to the controller 250.

The switch 270 is arranged between the alternating current power supply 210 and the second heater 230 through the electric power line and is composed of switching elements such as triac. The switch 270 switches from a turn-on state of the second heater 230 in which the second heater 230 is connected to the alternating current power supply 210 to a turn-off state of the second heater 230 in which the second heater 230 is disconnected from the alternating current power supply 210 or vice versa.

The controller 250 includes a central processing unit (CPU). The controller 250 controls the switches 260, 270 to turn on or off the first and second heaters 220, 230 under turn-on/off patterns based on the temperature information of the first and second heaters 220, 230 received from the temperature detection units 222, 232. each of the turn-on/off patterns is composed of on/off patterns with, for example, half wave interval of the alternating current power supply 210 being constituted as a unit, which will be described later. Further, the controller 250 may be installed in the fixing device 200.

The storage unit 280 includes a nonvolatile semiconductor memory, hard disk drive (HDD) and the like. The storage unit 280 stores a table corresponding to the turn-on/off patterns for controlling turning on or off the first and second heaters 220, 230 for every predetermined duty ratio.

[Example of Turn-on/Off Pattern]

The following will describe turn-on/off patterns of the heaters with the half wave interval of the alternating current power supply 210 being constituted as a unit in a current waveform. FIGS. 4A through 4G respectively illustrate configurations of the turn-on/off patterns 1 through 7 with the half wave interval of the alternating current power supply 210 being constituted as a unit in a current waveform.

In FIGS. 4A through 4G, the turn-on segments are illustrated by solid lines and the turn-off segments are illustrated by dotted lines. The alternating current power supply 210 has a frequency of 50 Hz and one half wave interval is 10 ms.

FIG. 5 shows a relationship between each of the turn-on/off patterns 1 through 7 of the heaters and a determination result of flicker with a half wave interval of current waveform in the alternating current power supply 210 being constituted as a unit. The determination result of flicker shown in FIG. 5 indicates a result whether or not a measured flicker value when the heaters are successively turned on or off under the respective turn-on/off patterns 1 through 7 (one control interval) conforms to a previously set flicker regulation. When the measured flicker value exceeds the set flicker regulation value (for example, pst=1), the determination result thereof is indicated as a cross mark while when the measured flicker value is the set flicker regulation value or less, the determination result thereof is indicated as a circle mark.

Figure 4A:
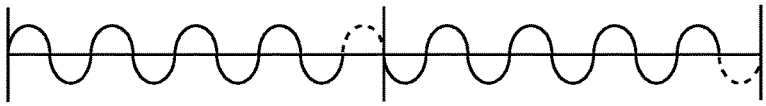
FIGS. 4A through 4G are graphs each showing a turn-on/off pattern of heaters.

FIG. 4A shows a configuration example of the turn-on/off pattern 1. The turn-on/off pattern 1 is a pattern with a duty ratio of 88.89%. The turn-on/off pattern 1 has one control interval of nine half wave intervals and is composed of eight turn-on segments and one turn-off segment. One control interval of this turn-on/off pattern 1 is 90 ms. In the turn-on/off pattern 1, as shown in FIG. 5, when the first heater 220 and the like are 1000 W or more, the determination result thereof was indicated as a cross mark while when they were less than 1000 W, the determination result of the flicker was indicated as a circle mark.

Figure 4B:
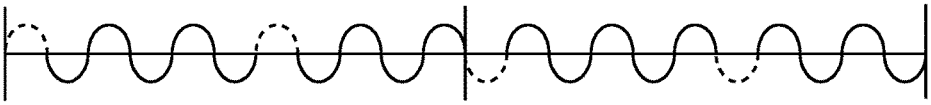

FIG. 4B shows a configuration example of the turn-on/off pattern 2. The turn-on/off pattern 2 is a pattern with a duty ratio of 81.8%. The turn-on/off pattern 2 has one control interval of eleven half wave intervals and is composed of nine turn-on segments and two turn-off segments. One control interval of this turn-on/off pattern 2 is 110 ms. In the turn-on/off pattern 2, as shown in FIG. 5, in both cases where the first heater 220 and the like were 1000 W or more and they were less than 1000 W, the determination results of the flicker were indicated as circle marks.

Figure 4C:
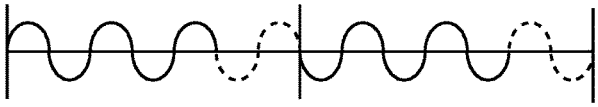

FIG. 4C shows a configuration example of the turn-on/off pattern 3. The turn-on/off pattern 3 is a pattern with a duty ratio of 71.43%. The turn-on/off pattern 3 has one control interval of seven half wave intervals and is composed of five turn-on segments and two turn-off segments. One control interval of this turn-on/off pattern 3 is 70 ms. In the turn-on/off pattern 3, as shown in FIG. 5, in both cases where the first heater 220 and the like were 1000 W or more and they were less than 1000 W, the determination results of the flicker were indicated as cross marks.

Figure 4D:
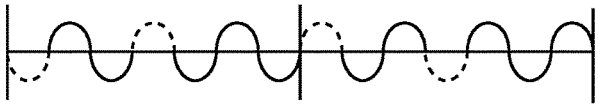

FIG. 4D shows a configuration example of the turn-on/off pattern 4. The turn-on/off pattern 4 is a pattern with a duty ratio of 71.43%. The turn-on/off pattern 4 has one control interval of seven half wave intervals and is composed of five turn-on segments and two turn-off segments. The turn-on/off pattern 4 has the turn-on segments and the turn-off segments, an order of which is different from those of turn-on/off pattern 3 (in other words, the phase thereof is shifted by half wave unit). One control interval of this turn-on/off pattern 4 is 70 ms. In the turn-on/off pattern 4, as shown in FIG. 5, when the first heater 220 and the like were 1000 W or more, the determination result thereof was indicated as a circle mark while when they were less than 1000 W, there was no data on the determination result of the flicker (which was indicated as dash mark in FIG. 5).

Figure 4E:
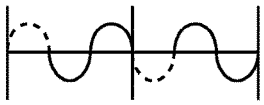

FIG. 4E shows a configuration example of the turn-on/off pattern 5. The turn-on/off pattern 5 is a pattern with a duty ratio of 66.67%. The turn-on/off pattern 5 has one control interval of three half wave intervals and is composed of two turn-on segments and one turn-off segment. One control interval of this turn-on/off pattern 5 is 30 ms. In the turn-on/off pattern 5, as shown in FIG. 5, in both cases where the first heater 220 and the like were 1000 W or more and they were less than 1000 W, the determination results of the flicker were indicated as circle marks.

Figure 4F:
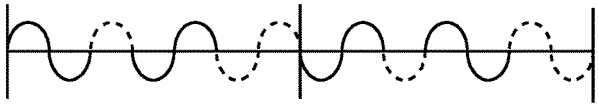

FIG. 4F shows a configuration example of the turn-on/off pattern 6. The turn-on/off pattern 6 is a pattern with a duty ratio of 57.14%. The turn-on/off pattern 6 has one control interval of seven half wave intervals and is composed of four turn-on segments and three turn-off segments. One control interval of this turn-on/off pattern 6 is 70 ms. In the turn-on/off pattern 6, as shown in FIG. 5, when the first heater 220 and the like were 1000 W or more, the determination result thereof was indicated as a cross mark while when they were less than 1000 W, there was no data on the determination result of the flicker (which was indicated as dash mark in FIG. 5).

Figure 4G:
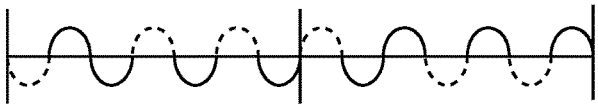

FIG. 4G shows a configuration example of the turn-on/off pattern 7. The turn-on/off pattern 7 is a pattern with a duty ratio of 57.14%. The turn-on/off pattern 7 has one control interval of seven half wave intervals and is composed of four turn-on segments and three turn-off segments. The turn-on/off pattern 7 has the turn-on segments and the turn-off segments, an order of which is different from those of the turn-on/off pattern 6 (in other words, the phase thereof is shifted by half wave unit). One control interval of this turn-on/off pattern 7 is 70 ms. In the turn-on/off pattern 7, as shown in FIG. 5, in both cases where the first heater 220 and the like were 1000 W or more and they were less than 1000 W, the determination results of the flicker were indicated as circle marks.

Thus, the inventors has studied such one control interval having various kinds of lengths and these orders so that they have found out following regularity in the turn-on/off patterns of the heaters which satisfy the flicker regulation. In the examples shown in FIGS. 4A through 4G, the turn-on/off patterns 2, 4, 5 and 7 satisfy the flicker regulation. Specifically, each of these turn-on/off patterns is configured to have one control interval which is odd number times (not less than 3) of the half wave interval. Either the turn-on segment or the turn-off segment is arranged for every half wave interval. Here, the orders of the turn-on segments and the turn-off segments are configured so that any segments having the smaller total number between the total number of the turn-on segments and the total number of the turn-off segments are discontinuous.

Although, in FIGS. 4A through 4G and 5, one control interval of the turn-on/off patterns has been set to have odd times of the half wave intervals of the turn-on/off patterns, this invention is not limited thereto: For example, one control interval of the turn-on/off patterns may be set to have even times of the half wave intervals if, when the turn-on/off patterns of the first and second heaters 220, 230 are combined and the heaters are turned on or off under the combined turn-on/off patterns, they conform to the flicker regulation. In the following description, in order to make the description plain, a case where one control interval of the turn-on/off patterns is set to have even times of the half wave intervals will be described.

Here, even when turning on or off the first and second heaters by combining the turn-on/off patterns shown in FIGS. 4A through 4G and 5, there may be a case where they cannot conform to any flicker regulation depending on power difference between the supplied power before the change of the turn-on/off patterns and the supplied power after the change of the turn-on/off patterns. Further, there may be a case where they cannot conform to any flicker regulation depending on length of a period of changing time (control interval) of the turn-on/off patterns.

Figure 6A:
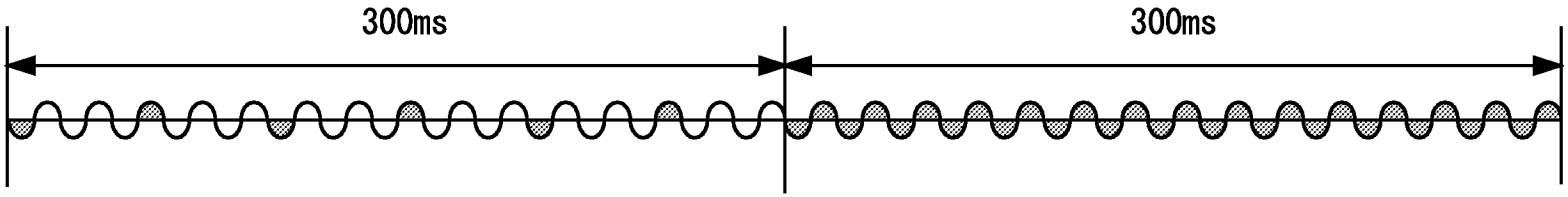
FIGS. 6A and 6B are graphs each showing a power difference between supplied power in the turn-on/off pattern of the heater before the change and supplied power in the turn-on/off pattern of the heater after the change.
Figure 6B:
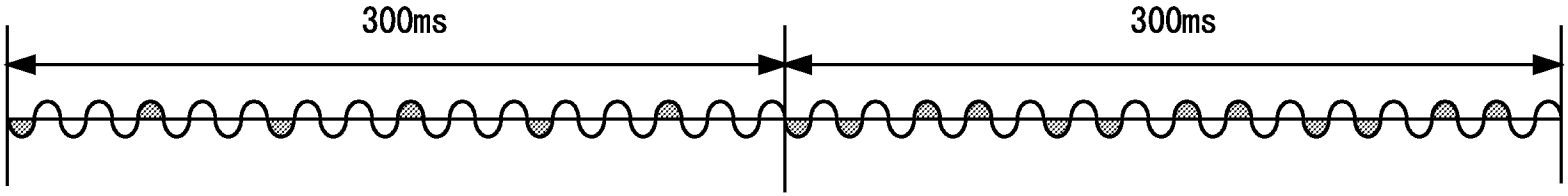
Figure 7:
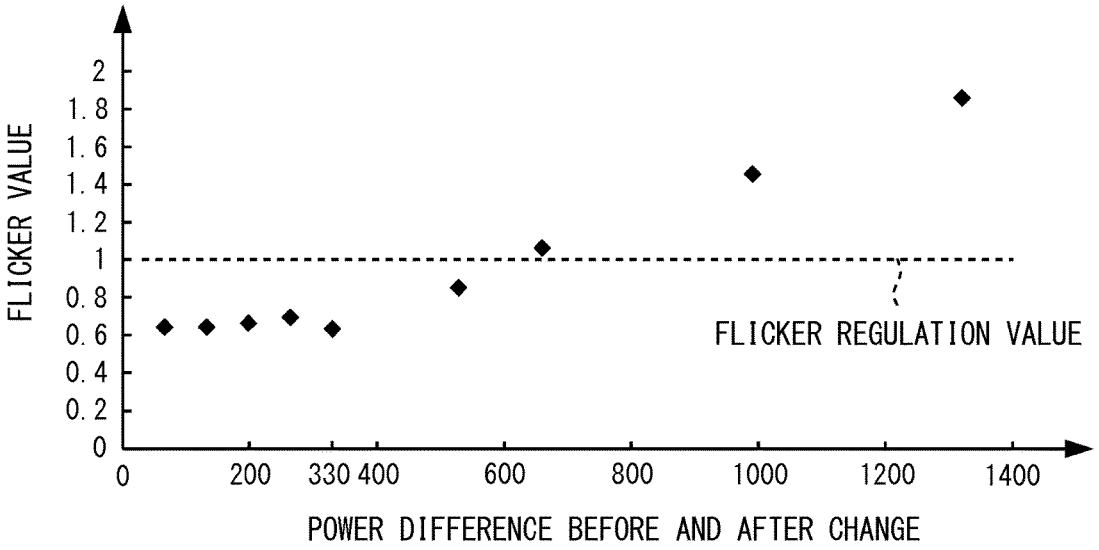
FIG. 7 is a graph showing a relationship between the power difference between the supplied power in the turn-on/off pattern of the heater before the change and the supplied power in the turn-on/off pattern of the heater after the change and a flicker value.

FIG. 6A shows an example of the change of the turn-on/off patterns of the heaters when exerting any influence to the flicker regulation and FIG. 6B shows an example of the change of the turn-on/off patterns of the heaters when exerting no influence to the flicker regulation. In FIGS. 6A and 6B, shaded waveform is set to be the turn-on segments and no-shaded waveform is set to be the turn-off segments. In order to make the description plain, the turn-on/off pattern having one control interval of 30 half wave intervals is used and the control interval thereof is set to be 300 ms. FIG. 7 shows a relationship between the power difference between the supplied power in the turn-on/off patterns of the heaters before the change and the supplied power in the turn-on/off patterns of the heaters after the change and a flicker value. A vertical axis of FIG. 7 indicates the flicker value and a horizontal axis thereof indicates the power difference. Further, a flicker regulation value is set to be, for example, one in FIG. 7.

As shown in FIG. 6A, when the turn-on/off pattern of the heaters with the duty ratio of 20% is changed to the turn-on/off pattern of the heaters with the duty ratio of 100%, the supplied power to the heaters is changed from 200 W to 1000 W so that the power difference between the supplied power in the turn-on/off patterns of the heaters before the change and the supplied power in the turn-on/off patterns of the heaters after the change is 800 W. When the power difference is thus increased, the flicker value is about 1.3 as shown in FIG. 7. It is understood that such a flicker value does not conform to any flicker regulation.

On the other hand, as shown in FIG. 6B, when the turn-on/off pattern of the heaters with the duty ratio of 20% is changed to the turn-on/off pattern of the heaters with the duty ratio of 40%, the supplied power to the heaters is changed from 200 W to 400 W so that the power difference between the supplied power in the turn-on/off patterns of the heaters before the change and the supplied power in the turn-on/off patterns of the heaters after the change is 200 W. Even when the power difference is thus increased, the flicker value is about 0.6 as shown in FIG. 7. It is understood that such a flicker value conforms to the flicker regulation.

Accordingly, in this invention, when changing the turn-on/off patterns of the heaters, the controller 250 selects a turn-on/off pattern with a duty ratio so that a power difference between power of the turn-on/off pattern before the change and power of the turn-on/off pattern after the change is less than a previously set reference power difference and controls the switched 260, 270 to turn on or off the heaters 220, 230 under the selected turn-on/off patterns to heat the fixing device 200.

Since, as shown in FIG. 7, the flicker value has a tendency to increase over the power difference of 330 W between power of the turn-on/off pattern before the change and power of the turn-on/off pattern after the change, the reference power difference is set to be 330 W in this embodiment. Therefore, it is possible to conform to the flicker regulation surely by setting the power difference between power of the turn-on/off pattern before the change and power of the turn-on/off pattern after the change to be less than 330 W.

For example, a turn-on/off pattern of the heaters among the turn-on/off patterns shown in FIGS. 4A through 4G such that it has one control interval of 10 half wave intervals or more and the power difference between power of the turn-on/off pattern before the change and power of the turn-on/off pattern after the change is less than the reference power difference may be selected. It is possible to control the switches to turn on or off the heaters with more high accuracy by selecting the turn-on/off patterns of the heaters with 10 half wave intervals or more.

Figure 8:
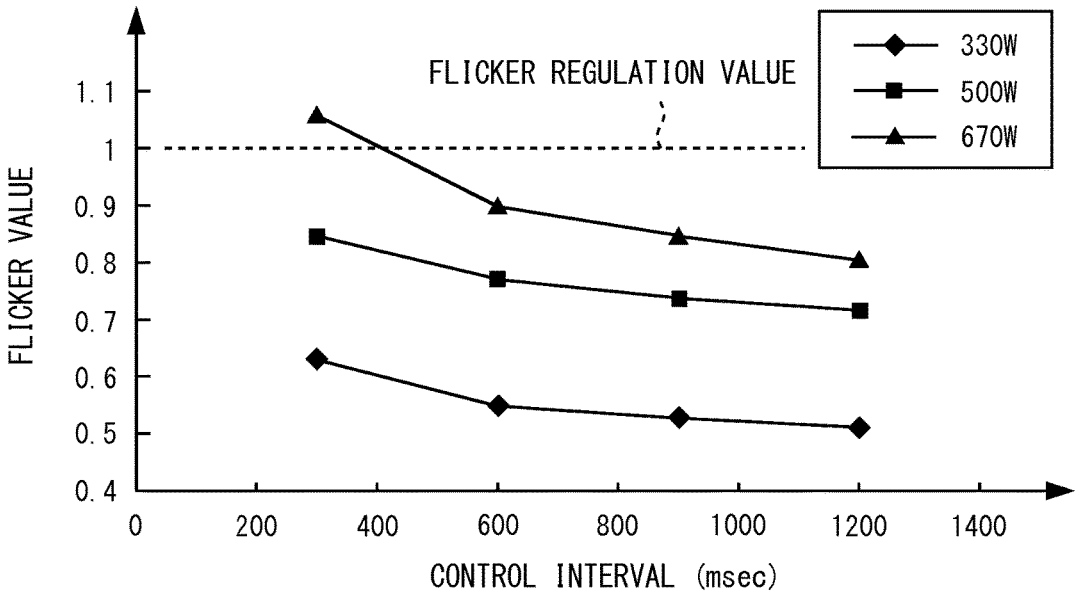
FIG. 8 is a graph showing a relationship between a control interval of the turn-on/off pattern and the flicker value.

FIG. 8 shows a relationship between a period of changing time (control interval) of the turn-on/off patterns and the flicker value after the change thereof. As shown in FIG. 8, in every one case of the power differences of 330 W, 500 W and 670 W, between power of the turn-on/off pattern before the change and power of the turn-on/off pattern after the change, it is understood that the shorter, the control interval of the turn-on/off interval is, the flicker value is increased. For example, when the power differences between power of the turn-on/off pattern before the change and power of the turn-on/off pattern after the change is 670 W and the control interval is 300 ms, it is understood that the flicker value cannot conform to the flicker regulation because of shorter control interval thereof. On the other hand, in a case where the control interval exceeds a period of set time, for example, 900 ms, it is understood that the flicker value stays below the flicker regulation value and is saturated. Further, when the control interval exceeds 1500 ms, a result such that this might exert any influence on a response to temperature control during the heating period was obtained.

Accordingly, in this invention, when changing the turn-on/off patterns of the heaters, the controller 250 sets the control interval, which is a basis of the turn-on/off pattern, to be longer than a first period of time (900 ms) that does not exert any influence to a flicker value and to be shorter than a second period of time (1500 ms) that does not exert any influence to the response to temperature control. Particularly, it is desirable to adjust the control interval during a processing in which high temperature control is not required, for example, a standby processing or in a case where the power differences between the supplied power of the turn-on/off pattern before the change and the supplied power of the turn-on/off pattern after the change exceeds the reference power difference.

Operation Example of Image-Forming Apparatus

Figure 9:
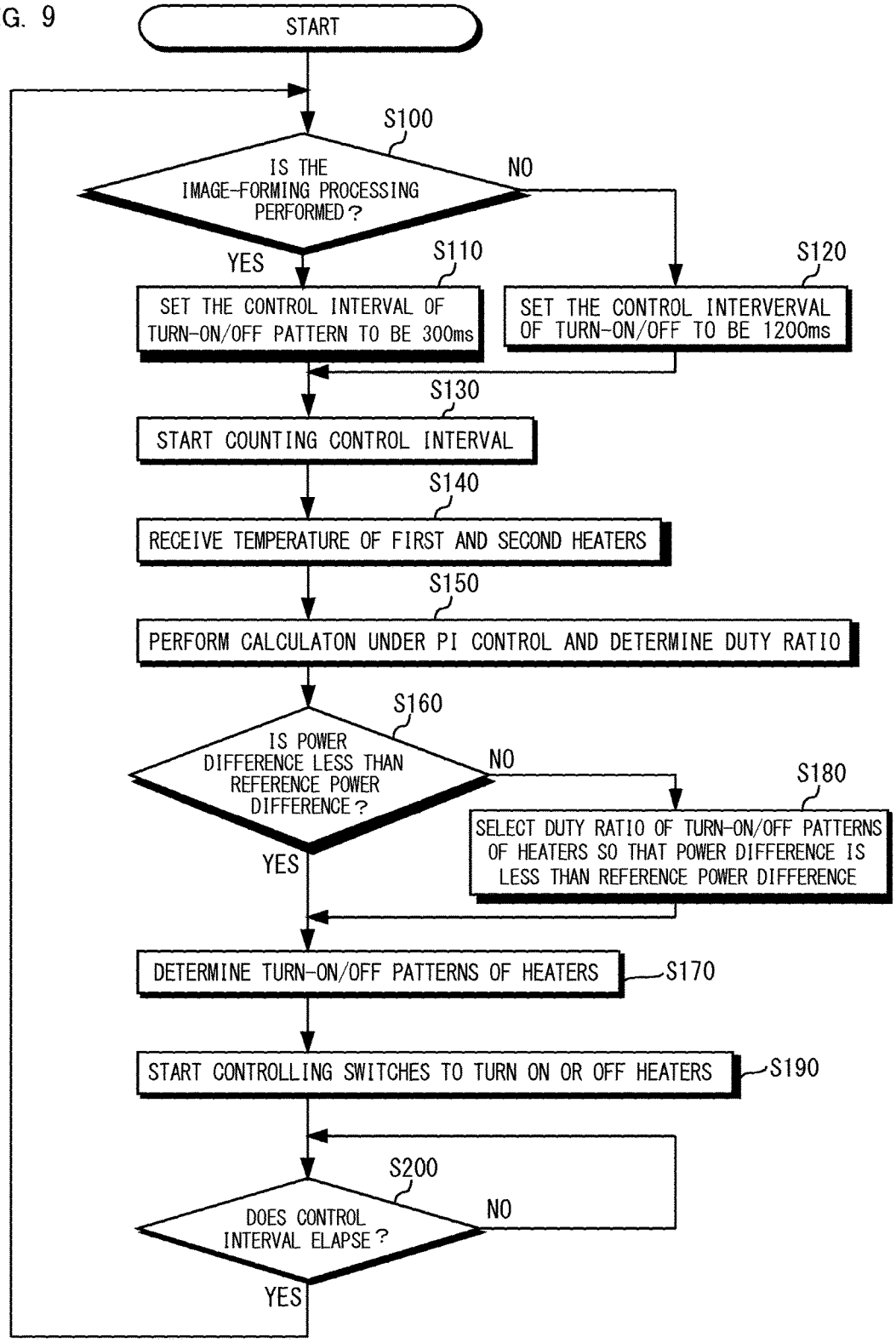
FIG. 9 is a flowchart showing an operation example of the image-forming apparatus during a temperature control of the heaters.

The following will describe an operation example of the image-forming apparatus 100 according to the first embodiment of this invention with reference to FIG. 9 when adjusting the temperature by the first and second heaters 220, 230.

As shown in FIG. 9, at a step S100, the controller 250 of the image-forming apparatus 100 judges whether or not an image-forming processing (copy) is performed to print the image on a sheet P. If the controller 250 judges that the image-forming processing is performed, the controller 250 goes to a step S110. On the other hand, if the controller 250 judges that the image-forming processing is not performed, the controller 250 goes to a step S120. As a case where the image-forming processing is not performed, for example, a case where the image-forming apparatus 100 is on standby is illustrated.

When the controller 250 judges that the image-forming processing is performed, at the step S110, the controller 250 sets the control interval of the turn-on/off pattern to be 300 ms. This is because enhancement of the response to the temperature control is preferable for corresponding to any rapid temperature variation since quantities of heat taken away from the heating roller 202 are increased by transfer of the sheets P during the image-forming processing so that variation in the temperature of the heating roller 202 is also increased. This is also because, during the image-forming processing, the temperature of the heating roller 202 is preferable to be kept constant with a high precision. Moreover, the control interval is not limited to 300 ms. Even when the control interval of the turn-on/off pattern of the heaters is short, this exerts any little influence on a flicker in a case where the power difference between power of the turn-on/off pattern before the change and power of the turn-on/off pattern after the change is small.

On the other hand, when the controller 250 judges that the image-forming processing is not performed, at the step S120, the controller 250 sets the control interval of the turn-on/off pattern to be 1200 ms. This is because the image-forming apparatus waits for user's print instruction when the image-forming apparatus is on standby so that the temperature of the fixing device 200 may be kept constant to some extent and the high precision of temperature control during the image-forming processing is not required. Moreover, the control interval is not limited to 1200 ms. When the control interval of the turn-on/off pattern of the heaters is within a range from 900 ms to 1500 ms, this does not exert any influence on a flicker, thereby avoiding lowering the response.

When using the turn-on/off patterns by combining the turn-on/off patterns with different number of orders (during one control interval) as the turn-on/off patterns of the first and second heaters 220, 230, it is possible to select the control interval which is near the control interval as a basis among the orders that are common multiple of these turn-on/off patterns. Further, when using the turn-on/off patterns whose numbers of orders are different, a control such that after the set control interval is finished, a turn-on/off pattern of a next control interval is changed is available. Similarity is applicable to other embodiments, which will be described later.

At a step S130, the controller 250 starts counting the set control interval. For example, the controller 250 starts counting the control interval of 300 ms when the image-forming apparatus 100 is during the image-forming processing or starts counting the control interval of 1200 ms when the image-forming apparatus 100 is on standby.

At a step S140, the controller 250 receives the temperature information of the first heater 220 from the temperature detection unit 222 and receives the temperature information of the second heater 230 from the temperature detection unit 232.

At a step S150, the controller 250 performs a calculation under, for example, PI control by using pieces of temperature information of the first and second heaters 220, 230 thus obtained and determines duty ratio of the turn-on/off patterns of the heaters when the first and second heaters 220, 230 are turned on or off. For example, by using a table in which calculated values under PI control correspond to the duty ratios of respective turn-on/off patterns, it is possible to determine the duty ratio of the turn-on/off patterns of the first and second heaters 220, 230.

At a step S160, the controller 250 judges whether or not the power difference between supplied power of the turn-on/off pattern (second turn-on/off pattern) with the determined duty ratio after the change and supplied power of the turn-on/off pattern (first turn-on/off pattern) with the duty ratio before the change is less than a previously set reference power difference. For example, the reference power difference is set to be 330 W (see FIG. 7). Further, the reference power difference may vary during the image-forming processing and when the image-forming apparatus 100 is on standby (other than the image-forming processing). For example, when the image-forming apparatus 100 is on standby, the very high temperature control is not required so that the reference power difference may be set to be 550 W.

If the controller 250 judges that the power difference between supplied power of the turn-on/off pattern after the change and supplied power of the turn-on/off pattern before the change is less than the reference power difference, the controller 250 goes to a step S170. On the other hand, if the controller 250 judges that the power difference between supplied power of the turn-on/off pattern after the change and supplied power of the turn-on/off pattern before the change exceeds the reference power difference, the controller 250 goes to a step S180.

If the power difference exceeds the reference power difference, at the step S180, the controller 250 selects the duty ratio of the turn-on/off patterns of the heaters so that the power difference between supplied power of the turn-on/off pattern after the change and supplied power of the turn-on/off pattern before the change is less than the reference power difference. For example, the controller 250 may select the duty ratio of the turn-on/off patterns after the change so that the power difference between the supplied power of the turn-on/off pattern after the change and supplied power of the turn-on/off pattern before the change is less than the reference power difference. Aside from this, the controller 250 may insert a turn-on/off pattern of duty ration so that the power difference between the adjacent turn-on/off patterns is less than the reference power difference between the turn-on/off patterns before and after the change, which will be later.

Additionally, during the image-forming processing, it is possible to change the control interval (300 ms) of the turn-on/off patterns to a value within arrange of 900 ms to 1500 ms, which does not exert any influence on the flicker value. This lowers the response to the temperature control a little but enables the flicker value to conform to the flicker regulation surely.

At the step S170, the controller 250 finally determines the turn-on/off patterns of the first and second heaters 220, 230. The controller 250 determines the turn-on/off patterns of the heaters corresponding to the determined duty ratio with reference to FIGS. 4A through 4G and 5.

At a step S190, the controller 250 starts controlling the switches 260, 270 to turn on or off the first and second heaters 220, 230 based on the determined turn-on/off patterns.

At a step S200, the controller 250 judges whether or not a set period of control time elapses. If the controller 250 judges that the set period of control time elapses, the controller 250 returns to the step S100 where the controller 250 judges whether or not the image-forming processing is performed and repeats the above-mentioned processing. On the other hand, if the controller 250 judges that the set period of control time does not elapse, the controller 250 continues to count until the set period of control time elapses.

As described above, in the first embodiment, when the image-forming apparatus 100 is on standby other than the image-forming processing, the controller 250 sets the control interval of the turn-on/off patterns of the first and second heaters to be a value included within a range from 900 ms to 1500 ms, the value exerting no influence on the flicker value and the response to temperature control. This allows conforming to the flicker regulation surely and preventing the response to the temperature control from being delayed at the same time.

Further, according to the turn-on/off control of the heaters under the turn-on/off patterns described in the first embodiment, it is possible to improve temperature ripples in the fixing device.

Additionally, in the first embodiment, when the power difference between power of the turn-on/off pattern P1 before the change and power of the turn-on/off pattern P2 after the change exceeds the reference power difference, the controller 250 selects the turn-on/off patterns of the heaters with the duty ratio so that power difference between the adjacent turn-on/off patterns is less than the reference power difference. Therefore, it is possible to prevent supplied power from rapidly varying when changing the turn-on/off patterns. This allows the flicker value to stay below the flicker regulation value surely even when the control interval of the turn-on/off pattern is short during, for example, the image-forming processing.

Second Embodiment

The following will describe a fixing device and an image-forming apparatus according to a second embodiment of this invention in which when the power difference between power of the turn-on/off pattern P1 before the change thereof and power of the turn-on/off pattern P2 after the change thereof exceeds the reference power difference, the controller 250 inserts between the turn-on/off patterns P1 before the change and the turn-on/off patterns P2 after the change, the turn-on/off patterns of the heaters with the duty ratio so that power difference between the adjacent turn-on/off patterns is less than the reference power difference. This turn-on/off control may be applied to any of the image-forming processing case and the standby case other than the image-forming processing. Similarity is applied to third through fifth embodiments, which will be described later. It is to be noted that other configurations and operations of the fixing device and the image-forming apparatus according to the second embodiment are similar to those of the fixing device and the image-forming apparatus according to the first embodiment so that like numbers indicate like components in this embodiment, the detailed description of which will be omitted.

Figure 10A:
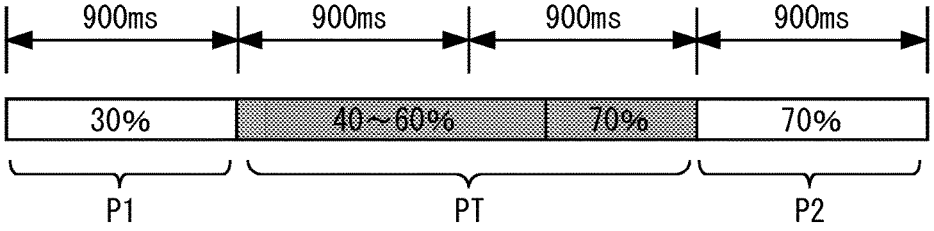
FIGS. 10A and 10B are diagrams each illustrating a through-up turn-on/off patterns to be inserted between the turn-on/off patterns of the heaters before and after the change in a fixing device or an image-forming apparatus according to a second embodiment of this invention.
Figure 10B:
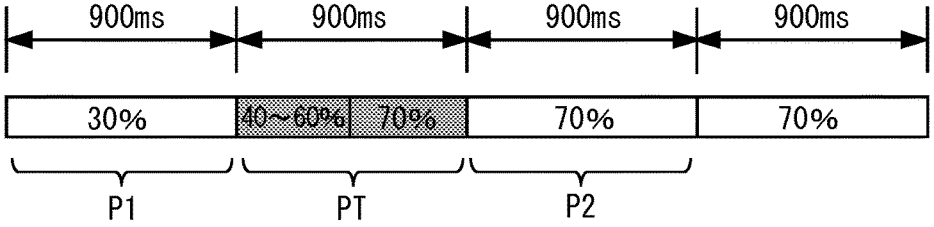

FIGS. 10A and 10B respectively illustrate turn-on/off patterns to be inserted when the power difference between power of the turn-on/off pattern P1 before the change and power of the turn-on/off pattern P2 after the change exceeds the reference power difference. The following will describe a case where, in the fixing device or the image-forming apparatus shown in FIGS. 10A and 10B, the power consumption of each of the first and second heaters 220, 230 is 1000 W and the duty ratio of each of the first and second heaters 220, 230 changes from 30% to 70%. The reference control interval is set to be, for example, 900 ms. The reference control interval is suitably set before shipment of the image-forming apparatus 100 or under real operation conditions of the fixing device 200 and the image-forming apparatus 100.

As shown in FIG. 10A, when changing the duty ratio of the turn-on/off pattern of the first heater 220 from 30% to 70%, the supplied power of the turn-on/off pattern P1 (first turn-on/off pattern) before the change is 300 W and the supplied power of the turn-on/off pattern P2 (second turn-on/off pattern) after the change is 700 W. In this case, the power difference between power of the turn-on/off pattern P1 before the change and power of the turn-on/off pattern P2 after the change is 400 W. This power difference exceeds the reference power difference, 330 W.

Accordingly, the controller 250 selects the turn-on/off patterns (hereinafter, referred to as "the through-up turn-on/off patterns") of the heaters, the through-up turn-on/off patterns having a reference control interval unit (which is an integral multiple of control interval) and having power so that the power difference between power of the turn-on/off patterns P1 before the change and power of the turn-on/off patterns P2 after the change is less than the reference power difference. The controller 250 inserts the through-up turn-on/off patterns between the turn-on/off patterns P1 before the change and the turn-on/off patterns P2 after the change. These through-up turn-on/off patterns constitute an example of third turn-on/off pattern of the heaters.

Specifically, the controller 250 selects, for example, the through-up turn-on/off patterns PT with the duty ratios of 40%, 50%, 60% and 70% and sets the control intervals of through-up turn-on/off patterns PT to be completed at 1800 ms which are two times of the reference control interval, 900 ms. The controller 250 inserts these through-up turn-on/off patterns PT with their duty ratios being increased step by step. This allows the power difference between the supplied powers of the adjacent turn-on/off patterns to be less than the reference power difference.

The controller 250 inserts the through-up turn-on/off patterns PT after it controls the switches 260, 270 to turn on or off the heaters 220, 230. The controller 250 controls the switches 260, 270 to turn on or off the heaters 220, 230 under these through-up turn-on/off patterns PT and starts counting the control intervals. Next, the controller 250 changes the through-up turn-on/off patterns PT the to a next turn-on/off patterns P2 when finishing count of 1800 ms, which are the control intervals of the through-up turn-on/off patterns PT, and newly starts counting the control interval of 900 ms in the turn-on/off patterns P2.

Although it has been described in the embodiment shown in FIG. 10A that the through-up turn-on/off patterns PT has been completed at a point of time when 1800 ms have elapsed, the through-up turn-on/off patterns PT may be set to be completed at a point of time when 900 ms have elapsed, as shown in FIG. 10B.

As described above, since the through-up turn-on/off patterns PT is inserted between the turn-on/off patter P1 before the change and the turn-on/off patter P2 after the change in the second embodiment, the fixing device 200 and the image-forming apparatus 100 according to the second embodiment may increase the duty ratio step by step between the turn-on/off patterns P1 and P2. This enables the power difference between the supplied powers of the adjacent turn-on/off patterns to become less than the reference power difference, thereby, allowing the flicker value to conform to the flicker regulation surely. Further, since the through-up turn-on/off patterns PT set the duty ratio thereof in unit of, for example, 10%, the power difference may be set to be less than the reference power difference even between the through-up turn-on/off patterns PT.

Since the control interval of the through-up turn-on/off patterns PT or that of the turn-on/off pattern P2 is set to be a value within a range from 900 ms to 1500 ms, it is possible to maintain the response to the temperature control and stay the flicker below the flicker regulation value surely. It is to be noted that the through-up turn-on/off patterns PT does not exert any influence on the temperature control of the heaters because the through-up turn-on/off patterns PT continue only in units of some hundreds milliseconds when the controller 250 inserts the through-up turn-on/off patterns PT between the turn-on/off patterns P1 and P2.

Further, when the duty ratio of each of the turn-on/off patterns of the first and second heaters 220, 230 changes from 70% to 30%, the power difference between power of the turn-on/off pattern P1 before the change and power of the turn-on/off pattern P2 after the change is also 400 W. In this case, this power difference also exceeds the reference power difference, 330 W. Accordingly, in this case, the controller 250 selects the turn-on/off patterns (hereinafter, referred to as "the through-down turn-on/off patterns") of the heaters, the through-down turn-on/off patterns having a reference control interval unit (which is an integral multiple of control interval) and having power so that the power difference between power of the turn-on/off patterns P1 before the change and power of the turn-on/off patterns P2 after the change is less than the reference power difference. The controller 250 inserts the through-down turn-on/off patterns between the turn-on/off patterns P1 before the change and the turn-on/off patterns P2 after the change. These through-down turn-on/off patterns constitute an example of third turn-on/off pattern of the heaters.

Third Embodiment

The following will describe a fixing device and an image-forming apparatus according to a third embodiment of this invention which are different from those of the first embodiment in that the turn-on/off patterns having the control interval which is shorter than the reference control interval are inserted between the turn-on/off patterns P1 and P2 before and after the change. It is to be noted that other configurations and operations of the fixing device and the image-forming apparatus according to the third embodiment are similar to those of the fixing device and the image-forming apparatus according to the first embodiment so that like numbers indicate like components in this embodiment, the detailed description of which will be omitted.

Figure 11:
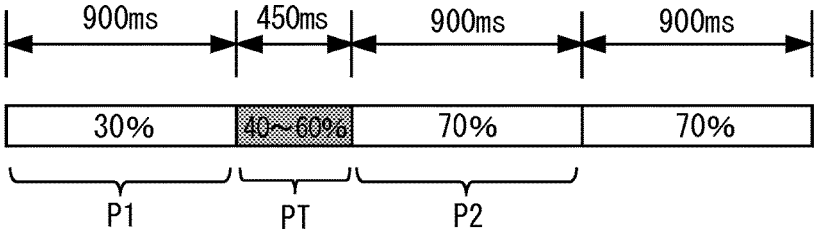
FIG. 11 is a diagram illustrating a through-up turn-on/off patterns to be inserted between the turn-on/off patterns of the heaters before and after the change in a fixing device or an image-forming apparatus according to a third embodiment of this invention.

FIG. 11 illustrate turn-on/off patterns to be inserted when the power difference between power of the turn-on/off pattern P1 before the change and power of the turn-on/off pattern P2 after the change exceeds the reference power difference. The following will describe a case where, in the fixing device or the image-forming apparatus shown in FIG. 11, the power consumption of each of the first and second heaters 220, 230 is 1000 W and the duty ratio of each of the first and second heaters 220, 230 changes from 30% to 70%. The reference control interval is set to be, for example, 900 ms.

The controller 250 judges whether or not it is desirable that the temperature of each of the first and second heaters 220, 230 immediately rises. The controller 250 also judges whether or not the power difference between supplied power of the turn-on/off pattern P1 before the change and supplied power of the turn-on/off pattern P2 after the change exceeds the reference power difference. The setting required when the temperature of each of the first and second heaters 220, 230 immediately rises may be selected by a user using an operation button indicating a mode in which the temperature immediately rises. The operation button is displayed on a screen of, for example, the manipulation/display unit 70. The controller 250 also may perform an automatic determination based on a fixing condition and/or image-forming condition of a job and the like.

When the controller 250 determines that these two judgements are satisfied, the controller 250 selects the through-up turn-on/off patterns PT which have shorter control interval than the reference control interval and have the power so that the power difference between the supplied power of the turn-on/off patterns P1 before the change and the supplied power of the turn-on/off patterns P2 after the change is less than the reference power difference. The controller 250 inserts the selected through-up turn-on/off patterns PT between the turn-on/off patterns P1 before the change and the turn-on/off patterns P2 after the change. Specifically, the controller 250 selects the through-up turn-on/off patterns PT which have the control interval of 450 ms and have the duty ratios of 40%, 50% and 60%. The controller 250 inserts the selected through-up turn-on/off patterns PT between the turn-on/off patterns P1 and P2. It is to be noted that the control interval is not limited to 450 ms.

The controller 250 controls the switches 260, 270 to turn on or off the heaters 220, 230 under the turn-on/off pattern P1 and then, inserts the through-up turn-on/off patterns PT. The controller 250 controls the switches 260, 270 to turn on or off the heaters 220, 230 under the through-up turn-on/off patterns PT thus inserted. The controller 250 then changes the through-up turn-on/off patterns PT to next turn-on/off patterns P2 after the controller 250 has finished counting the control interval of the through-up turn-on/off patterns PT of 450 ms and newly starts counting the control interval of the turn-on/off patterns P2 by 900 ms.

As described above, since the control interval of the through-up turn-on/off patterns PT is set to be shorter than the reference control interval in the third embodiment, it is possible to enhance the response to the temperature control and it is possible for the temperature of each of the first and second heaters 220, 230 to rapidly rise to a desired temperature (target temperature).

Further, according to the third embodiment, even when the power difference between the supplied power of the turn-on/off pattern P1 before the change and the supplied power of the turn-on/off pattern P2 after the change exceeds the reference power difference, the controller 250 inserts the through-up turn-on/off patterns PT between the turn-on/off patterns P1 before the change and the turn-on/off patterns P2 after the change so that it is possible to prevent the supplied power from suddenly varying. This allows the flicker value to conform to the flicker regulation surely. Similar effect may be obtained even when the through-down turn-on/off patterns are inserted between the turn-on/off patterns P1 before the change and the turn-on/off patterns P2 after the change.

The controller 250 may judge whether or not the turn-on/off control under the turn-on/off patterns having the shorter control interval is be performed according to processing capacity (arithmetic capacity). This is because if the turn-on/off control of the turn-on/off patterns having the shorter control interval when the controller 250 has less processing capacity, there is a possibility where the turn-on/off control is delayed. Accordingly, the controller 250 controls the switches 260, 270 to turn on or off the heaters 220, 230 under the through-up turn-on/off patterns PT having the shorter control interval in a case when the controller 250 itself has high processing capacity.

Fourth Embodiment

The following will describe a fixing device and an image-forming apparatus according to a fourth embodiment of this invention which are different from those of the first embodiment in that the turn-on/off patterns having the control interval which is longer than the reference control interval are inserted between the turn-on/off patterns P1 and P2 before and after the change. It is to be noted that other configurations and operations of the fixing device and the image-forming apparatus according to the third embodiment are similar to those of the fixing device and the image-forming apparatus according to the first embodiment so that like numbers indicate like components in this embodiment, the detailed description of which will be omitted.

Figure 12:
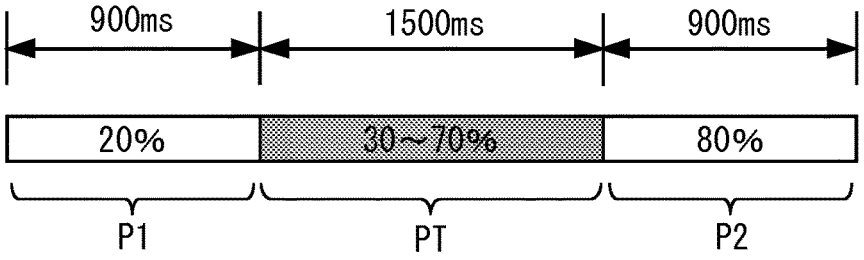
FIG. 12 is a diagram illustrating a through-up turn-on/off patterns to be inserted between the turn-on/off patterns of the heaters before and after the change in a fixing device or an image-forming apparatus according to a fourth embodiment of this invention.

FIG. 12 illustrate turn-on/off patterns to be inserted when the power difference between power of the turn-on/off pattern P1 before the change and power of the turn-on/off pattern P2 after the change exceeds the reference power difference. The following will describe a case where, in the fixing device or the image-forming apparatus shown in FIG. 12, the power consumption of each of the first and second heaters 220, 230 is 1000 W and the duty ratio of each of the first and second heaters 220, 230 changes from 20% to 80%. The reference control interval is set to be, for example, 900 ms.

As shown in FIG. 12, when changing the duty ratio, 20% of the turn-on/off patterns P1 of the first and second heaters 220, 230 from 20% to the duty ratio, 80% of the turn-on/off patterns P2 of the first and second heaters, the supplied power of the turn-on/off pattern P1 before the change is 200 W and the supplied power of the turn-on/off pattern P2 after the change is 800 W. In this case, the power difference between power of the turn-on/off pattern P1 before the change and power of the turn-on/off pattern P2 after the change is 600 W. This power difference is made larger.

When the power difference between power of the turn-on/off pattern P1 before the change and power of the turn-on/off pattern P2 after the change is made larger, the numbers of the through-up turn-on/off patterns PT to be inserted between the turn-on/off patterns P1 and P2 are increased so that the control interval of the through-up turn-on/off patterns PT may be more extended than the reference control interval. When inserting a plurality of the through-up turn-on/off patterns PT whose duty ratios are, for example, 30%, 40%, 50%, 60% and 70%, the control interval of the through-up turn-on/off patterns PT becomes 1500 ms.

In this case, the controller 250 changes the turn-on/off patterns P1 to the through-up turn-on/off patterns PT after the controller 250 has finished turning on or off the heaters under the turn-on/off pattern P1. The controller 250 starts counting the control interval of the through-up turn-on/off patterns PT and starts turning on or off the heaters under the through-up turn-on/off patterns PT. The controller 250 changes the through-up turn-on/off patterns PT to the next new turn-on/off patterns P2 after the controller 250 has finished counting the control interval of the through-up turn-on/off patterns PT by 1500 ms. The controller 250 starts counting the control interval of the turn-on/off patterns P2 and starts controlling the switches to turn on or off the heaters under the turn-on/off patterns P2.

As described above, according to the fourth embodiment, even when the numbers of the through-up turn-on/off patterns PT to be inserted between the turn-on/off patterns P1 and P2 are increased, the controller 250 starts counting the control interval of the next new turn-on/off patterns P2 at a stage of finishing controlling the through-up turn-on/off patterns PT. This enables the control interval of the next turn-on/off patterns P2 to be adjusted even when the power difference between the turn-on/off patterns before and after the change is made larger. Accordingly, it is possible to turn on or off the first and second heaters 220, 230 optimally.

Since the through-up turn-on/off patterns PT are inserted, the power difference between the power of the turn-on/off patterns P1 before the change and the power of the turn-on/off patterns P2 after the change may become less than the reference power difference. Further, since the control interval of through-up turn-on/off patterns PT is set to be shorter than 1500 ms, it is possible to maintain the response to the temperature control and it is possible for the flicker value to stay below the flicker regulation value surely. Similar result may be obtained even when the through-down turn-on/off patterns are inserted between the turn-on/off patterns P1 and P2 before and after the change.

Fifth Embodiment

The following will describe a fixing device and an image-forming apparatus according to a fifth embodiment of this invention which are different from those of the first embodiment in that processing speed of the controller 250 differs according to lengths of control intervals of the turn-on/off patterns. It is to be noted that other configurations and operations of the fixing device and the image-forming apparatus according to the fifth embodiment are similar to those of the fixing device and the image-forming apparatus according to the first embodiment so that like numbers indicate like components in this embodiment, the detailed description of which will be omitted.

In the fifth embodiment, the controller 250 has a low speed processing portion that performs the processing at intervals of, for example, 10 ms and a medium speed processing portion that performs the processing at intervals of, for example, 900 ms. Further, the controller 250 may have a high speed processing portion that performs the processing at a higher speed than the medium speed.

Figure 13A:
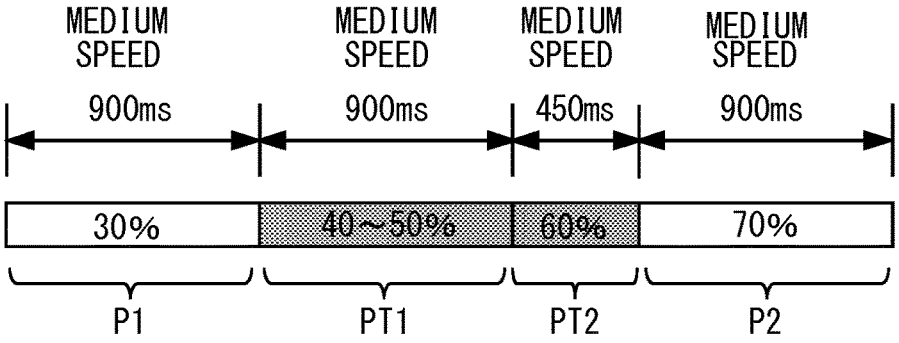
FIGS. 13A and 13B are diagrams each illustrating a through-up turn-on/off patterns to be inserted between the turn-on/off patterns of the heaters before and after the change in a fixing device or an image-forming apparatus according to a fifth embodiment of this invention.
Figure 13B:
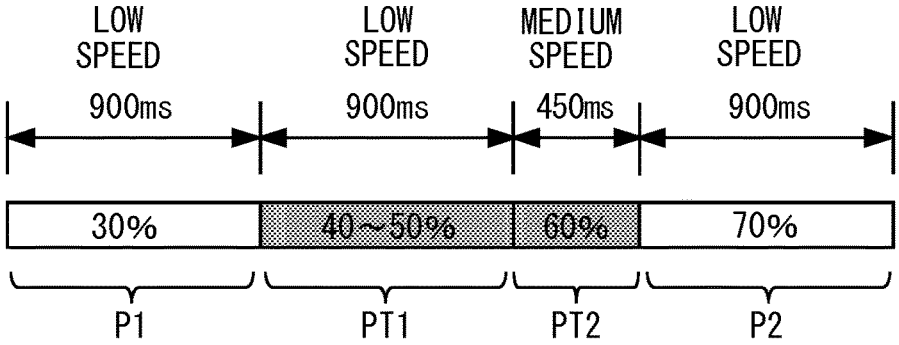

FIG. 13A illustrates a case where all of the turn-on/off patterns are processed at medium speed. FIG. 13B illustrates a case where the turn-on/off pattern having the shorter control interval is processed at medium speed but other turn-on/off patterns are processed at low speed. The following will describe a case where, in the fixing device or the image-forming apparatus shown in FIGS. 13A and 13B, the power consumption of each of the first and second heaters 220, 230 is 1000 W and the duty ratio of each of the first and second heaters 220, 230 changes from 30% to 70%. The reference control interval is set to be, for example, 900 ms.

As shown in FIG. 13A, the controller 250 controls the switches to turn on or off the heaters on all of the turn-on/off patterns P1, P2, and the though-up turn-on/off controls PT1, PT2 at the medium speed by the medium speed processing portion. On the other hand, as shown in FIG. 13B, the controller 250 controls the switches to turn on or off the heaters on the turn-on/off patterns P1 and the though-up turn-on/off controls PT1, the control interval of which is 900 ms, at the low speed by the low speed processing portion. The controller 250 then changes the processing speed from the low speed to the medium speed and controls the switches to turn on or off the heaters on the through-up turn-on/off patterns PT2, the control interval of which is 450 ms, at the medium speed by the medium speed processing portion. Next, the controller 250 changes the processing speed from the medium speed to the low speed after the turn-on/off control has been finished in the through-up turn-on/off patterns PT2 and controls the switches to turn on or off the heaters on the turn-on/off patterns P2, the control interval of which is 900 ms, at the low speed by the low speed processing portion.

As described above, according to the fifth embodiment, the processing speed of the controller 250 changes according to the lengths of the control intervals of the turn-on/off patterns of the heaters. Namely, when the control interval of the turn-on/off patterns is short and the high arithmetic capacity is required, the controller 250 controls the switches to turn on or off the heaters on the turn-on/off patterns at the medium speed. On the other hand, when the control interval of the turn-on/off patterns is relatively long and the high arithmetic capacity is not required, the controller 250 controls the switches to turn on or off the heaters on the turn-on/off patterns at the low speed. This enables arithmetic capacity of the medium speed processing portion to be shared with other processing such as the image-forming processing. As a result thereof, resources of the controller 250 can be effectively used so that the controller 250 can perform the turn-on/off control of the heaters and the image-forming processing rapidly and effectively. Similar effect maybe obtained even when the through-down turn-on/off patterns are inserted between the turn-on/off patterns P1 before the change and the turn-on/off patterns P2 after the change.

It should be understood by those skilled in the art that various modifications, combinations, sub-combinations and alterations may occur depending on design requirements and other factors insofar as they are within the scope of the appended claims or the equivalents thereof. Although, in the above-mentioned embodiments, the case where the controller 250 controls the two first and second heaters 220, 230 to turn on or off the power thereof has been described, this invention is not limited thereto: For example, this invention is applicable to a case where the controller 250 controls one heater or three heaters or more to turn on or off the power thereof.

Further, although the image-forming apparatus 100 that forms a color image has been described in the above embodiments, this invention is not limited thereto: For example, this invention is applicable to an image-forming apparatus that forms a monochrome image.

The invention claimed is:

1. A fixing device comprising:

an alternating current power supply;

plural heaters each fixing an image on a sheet;

a switching unit that switches from a turn-on state of the heaters in which the heaters are connected to the alternating current power supply to a turn-off state of the heaters in which the heaters are disconnected from the alternating current power supply or from the turn-off state of the heaters to the turn-on state of the heaters; and a control unit that controls the switching unit to switch under a turn-on/off pattern with a half wave interval of the alternating current power supply being constituted as a unit thereof and to turn on or off the plural heaters, wherein when changing the turn-on/off pattern, the control unit sets a control interval as a period of switching time in the turn-on/off pattern so as to be longer than a first period of time that does not exert any influence to a flicker value and to be shorter than a second period of time that does not exert any influence to a response to temperature control or the control unit selects a third turn-on/off pattern in which power difference between power of a first turn-on/off pattern before the change in the turn-on/off pattern and power of a second turn-on/off pattern after the change in the turn-on/off pattern is smaller than a set reference power difference.

2. The fixing device according to claim 1 wherein when the power difference between the power of the first turn-on/off pattern before the change in the turn-on/off pattern and the power of the second turn-on/off pattern after the change in the turn-on/off pattern exceeds the reference power difference, the control unit sets a control interval of at least any one of the second and third turn-on/off patterns so as to be longer than the first period of time and shorter than the second period of time.

3. The fixing device according to claim 1 wherein the first period of time is 900 ms and the second period of time is 1500 ms.

4. The fixing device according to claim 1 wherein the reference power difference is 330 W.

5. The fixing device according to claim 1 wherein when the power difference between the power of the first turn-on/off pattern before the change in the turn-on/off pattern and the power of the second turn-on/off pattern after the change in the turn-on/off pattern exceeds the reference power difference, the control unit inserts the third turn-on/off pattern between the first and second turn-on/off patterns, the third turn-on/off pattern being completed at a unit of the control interval of each of the first and second turn-on/off patterns.

6. The fixing device according to claim 1 wherein when the power difference between the power of the first turn-on/off pattern before the change in the turn-on/off pattern and the power of the second turn-on/off pattern after the change in the turn-on/off pattern exceeds the reference power difference, the control unit inserts the third turn-on/off pattern between the first and second turn-on/off patterns, the third turn-on/off pattern having a shorter interval than a reference control interval of the first and second turn-on/off patterns.

7. The fixing device according to claim 6 wherein the control unit determines whether or not the heaters are turned on or off under the third turn-on/off pattern based on processing capacity of the control unit.

8. The fixing device according to claim 6 wherein when the heaters turn on or off under the third turn-on/off pattern, the control unit controls the switching unit to turn the heaters on or off at a processing speed faster than both of processing speeds at which the heaters turn on or off under the first and second turn-on/off patterns.

9. The fixing device according to claim 1 wherein when the power difference between the power of the first turn-on/off pattern before the change in the turn-on/off pattern and the power of the second turn-on/off pattern after the change in the turn-on/off pattern exceeds the reference power difference, the control unit inserts the third turn-on/off pattern between the first and second turn-on/off patterns, the third turn-on/off pattern having a longer interval than the control interval of each of the first and second turn-on/off patterns, and after the third turn-on/off pattern completes, the control unit changes the third turn-on/off pattern to the second turn-on/off pattern to start counting the control interval of the second turn-on/off pattern.

10. The fixing device according to claim 1 wherein each of the turn-on/off patterns is configured to include 10 half wave intervals or more of the alternating current power supply as one control interval.

11. An image-forming apparatus comprising:

an image-forming portion that forms an image on a sheet;

a fixing portion that fixes the image formed on the sheet by the image-forming portion; and a control portion that controls at least the fixing portion, wherein the fixing portion contains:

an alternating current power supply;

plural heaters each fixing an image on a sheet; and a switching unit that switches from a turn-on state of the heaters in which the heaters are connected to the alternating current power supply to a turn-off state of the heaters in which the heaters are disconnected from the alternating current power supply or from the turn-off state of the heaters to the turn-on state of the heaters, wherein the control portion controls the switching unit to switch under a turn-on/off pattern with a half wave interval of the alternating current power supply being constituted as a unit thereof and to turn on or off the plural heaters and when changing the turn-on/off pattern, the control portion sets a control interval as a period of switching time in the turn-on/off pattern so as to be longer than a first period of time that does not exert any influence to a flicker value and to be shorter than a second period of time that does not exert any influence to a response to temperature control or the control portion selects a third turn-on/off pattern in which power difference between power of a first turn-on/off pattern before the change in the turn-on/off pattern and power of a second turn-on/off pattern after the change in the turn-on/off pattern is smaller than a set reference power difference.

12. The image-forming apparatus according to claim 11 wherein when the power difference between the power of the first turn-on/off pattern before the change in the turn-on/off pattern and the power of the second turn-on/off pattern after the change in the turn-on/off pattern exceeds the reference power difference, the control portion sets a control interval of at least any one of the second and third turn-on/off patterns so as to be longer than the first period of time and shorter than the second period of time.

13. The image-forming apparatus according to claim 11 wherein the first period of time is 900 ms and the second period of time is 1500 ms.

14. The image-forming apparatus according to claim 11 wherein the reference power difference is 330 W.

15. The image-forming apparatus according to claim 11 wherein when the power difference between the power of the first turn-on/off pattern before the change in the turn-on/off pattern and the power of the second turn-on/off pattern after the change in the turn-on/off pattern exceeds the reference power difference, the control portion inserts the third turn-on/off pattern between the first and second turn-on/off patterns, the third turn-on/off pattern being completed at a unit of the control interval of each of the first and second turn-on/off patterns.

16. The image-forming apparatus according to claim 11 wherein when the power difference between the power of the first turn-on/off pattern before the change in the turn-on/off pattern and the power of the second turn-on/off pattern after the change in the turn-on/off pattern exceeds the reference power difference, the control portion inserts the third turn-on/off pattern between the first and second turn-on/off patterns, the third turn-on/off pattern having a shorter interval than a reference control interval of the first and second turn-on/off patterns.

17. The image-forming apparatus according to claim 16 wherein the control portion determines whether or not the heaters are turned on or off under the third turn-on/off pattern based on processing capacity of the control portion.

18. The image-forming apparatus according to claim 16 wherein when the heaters turn on or off under the third turn-on/off pattern, the control portion controls the switching unit to turn the heaters on or off at a processing speed faster than both of processing speeds at which the heaters turn on or off under the first and second turn-on/off patterns.

19. The image-forming apparatus according to claim 11 wherein when the power difference between the power of the first turn-on/off pattern before the change in the turn-on/off pattern and the power of the second turn-on/off pattern after the change in the turn-on/off pattern exceeds the reference power difference, the control portion inserts the third turn-on/off pattern between the first and second turn-on/off patterns, the third turn-on/off pattern having a longer interval than the control interval of each of the first and second turn-on/off patterns, and after the third turn-on/off pattern completes, the control portion changes the third turn-on/off pattern to the second turn-on/off pattern to start counting the control interval of the second turn-on/off pattern.

20. The image-forming apparatus according to claim 11 wherein each of the turn-on/off patterns is configured to include 10 half wave intervals or more of the alternating current power supply as one control interval.

* * * * *